US005396825A

United States Patent [19]

Kirts

[11] Patent Number: 5,396,825

[45] Date of Patent: Mar. 14, 1995

[54] AIR FLOW VALVE FOR MUSICAL INSTRUMENT

[75] Inventor: Herbert L. Kirts, Elkhart, Ind.

[73] Assignee: Selmer Corporation, Elkhart, Ind.

[21] Appl. No.: 77,058

[22] Filed: Jun. 16, 1993

[51] Int. Cl.[6] ..... G10D 9/04

[52] U.S. Cl. ..... 84/390

[58] Field of Search ..... 84/390, 388, 389, 391, 84/393, 394, 387 R, 395, 397

[56] References Cited

U.S. PATENT DOCUMENTS 5,919 11/1848 Paine ..... 84/390

4,685,372 8/1987 Kawasaki ..... 84/390

*Primary Examiner*—Michael L. Gellner

*Assistant Examiner*—Cassandra C. Spyrou

*Attorney, Agent, or Firm*—James D. Hall

[57] ABSTRACT

An air flow valve positioned along the air flow path in a wind instrument. The valve includes three air conduits and is shiftable between a first position wherein the air flows substantially straight through the main air passage to the bell, and a second position wherein the air flow is diverted to a slide loop and thence back to the main air passage. The valve includes a manual actuator which is easily accessed by the musician to shift the valve between its first and second positions during playing.

10 Claims, 7 Drawing Sheets

AIR FLOW VALVE FOR MUSICAL INSTRUMENT

FIELD OF THE INVENTION

This invention relates to musical instruments, and will have application to an air flow valve for changing the sound emitted from a wind instrument.

BACKGROUND OF THE INVENTION

Rotary air valves for wind type musical instruments are useful items which direct the air flow from the mouthpiece through either a main air passage or a slide loop.

Of particular interest are four U.S. Patents issued to Orla E. Thayer, U.S. Pat. Nos. 4,112,806; 4,213,371; 4,299,156; and 4,469,002. Each of these patents discloses the use of a rotary air valve positioned along the air flow path of a slide trombone. In each case, the rotary air valve serves to direct the air through either the main air conduit or to divert air into a slide loop and thence back into the main air conduit and to the instrument bell.

In each of the Thayer patents identified, the rotary air valve is positioned in the air flow path with the valve apertures and conduits positioned generally parallel to the axis of rotation of the valve rotor. This type of construction and valve orientation resulted in the formation of sharply inclined, diverging air passages which negatively affected the tonal quality of the sound produced. Also, these valves required relatively complex mechanical linkages between the actuating lever and the rotor which slowed the shifting of the rotor between its extreme positions. This flaw affected both the tonal quality of the sound and detracted from the playability of the instrument.

Also, the rotary valves disclosed in the Thayer patents teach the use of two air flow conduits through the rotor. The first air conduit is positioned along the axis of rotation of the rotor to allow the first conduit air outlet to remain in constant communication with the main conduit. In this fashion air flowing through the rotor first conduit must turn both axially and radially through the rotor before it reaches the main bore. This negatively affects tonal quality of the horn.

SUMMARY OF THE INVENTION

The rotary valve of this invention includes a rotor which is positioned along the air flow path generally perpendicular to the axis of rotation of the rotor. The rotor includes three air conduits. A first air conduit connects the main air conduit with the lead pipe in a substantially straight through path which produces little or no degradation of tonal quality. Second and third air conduits align with the lead pipe, slide loop and main conduit in a second position of the rotor. The second and third conduits are preferably axially aligned to allow the air flow a substantially straight path through the rotor which again produces little or no tonal degradation.

The perpendicular positioning of the rotor allows the air conduits to extend through the side wall of the rotor and eliminates the radial turns of the prior art valves. Further, the mechanism for effecting rotation of the rotor is simplified and allows for quick transition between the first and second positions of the rotor. This increases the playability of the instrument and enhances tonal quality.

Accordingly, it is an object of this invention to provide a novel and improved rotary air valve for a musical wind instrument.

Another object is to provide for a rotary air valve which enhances the tonal quality and the playability of the instrument.

Another object is to provide for a rotary air valve which may be quickly and easily shifted.

Another object is to provide for a rotary air valve which includes a dependable and readily adjustable shift mechanism.

Other objects will become apparent upon a reading of the following description.

BRIEF DESCRIPTION OF THE DRAWINGS

A preferred embodiment has been depicted for illustrative purposes wherein.

DESCRIPTION OF THE PREFERRED EMBODIMENT

The preferred embodiment herein described is not intended to be exhaustive or to limit the invention to the precise form disclosed. It is chosen and described to explain the principles of the invention and its application and practical use to enable others skilled in the art to follow its teachings.

Figure 1:
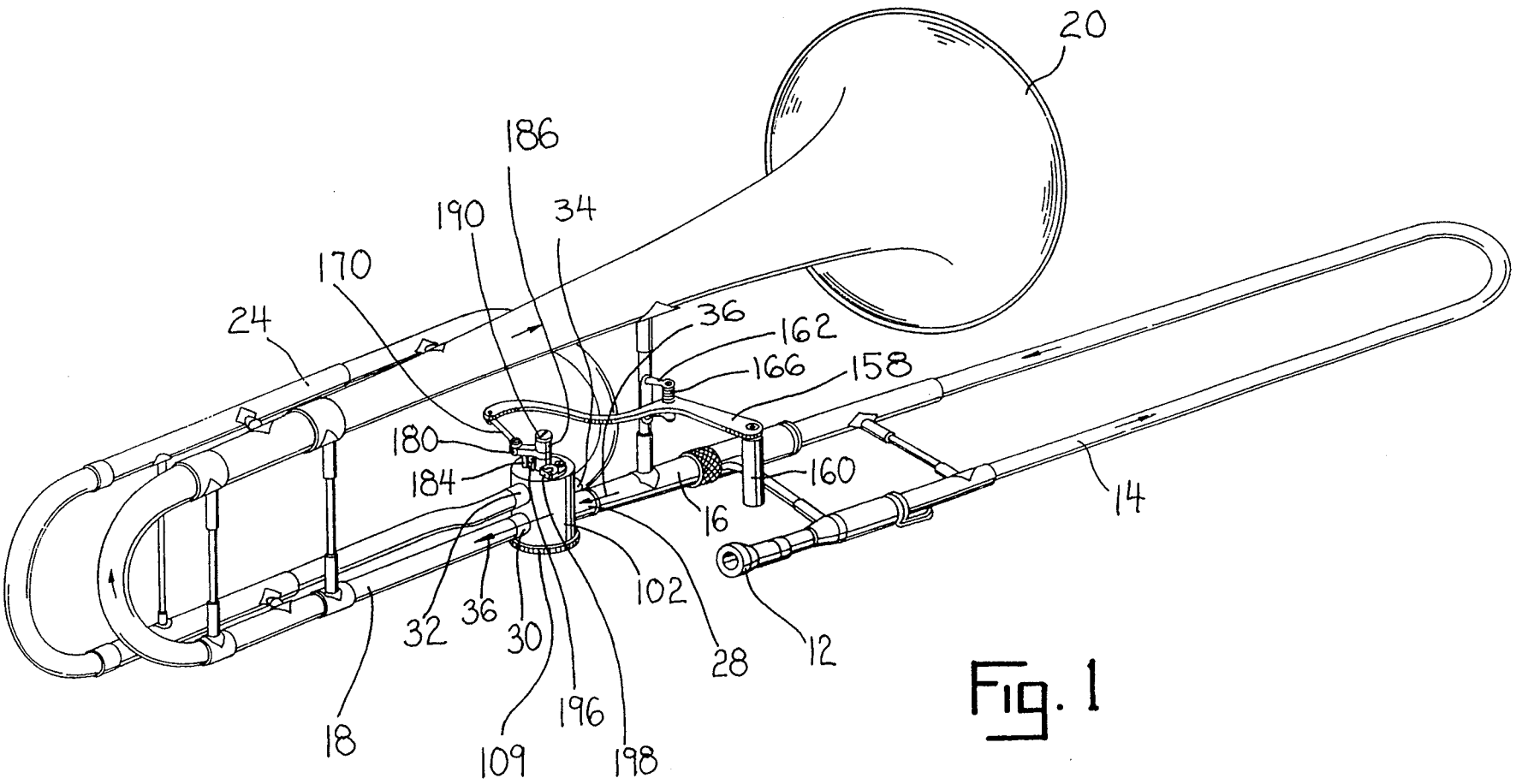
FIG. 1 is a perspective view of a slide trombone which incorporates the rotary air valve of this invention and illustrating the straight through air flow path.
Figure 2:
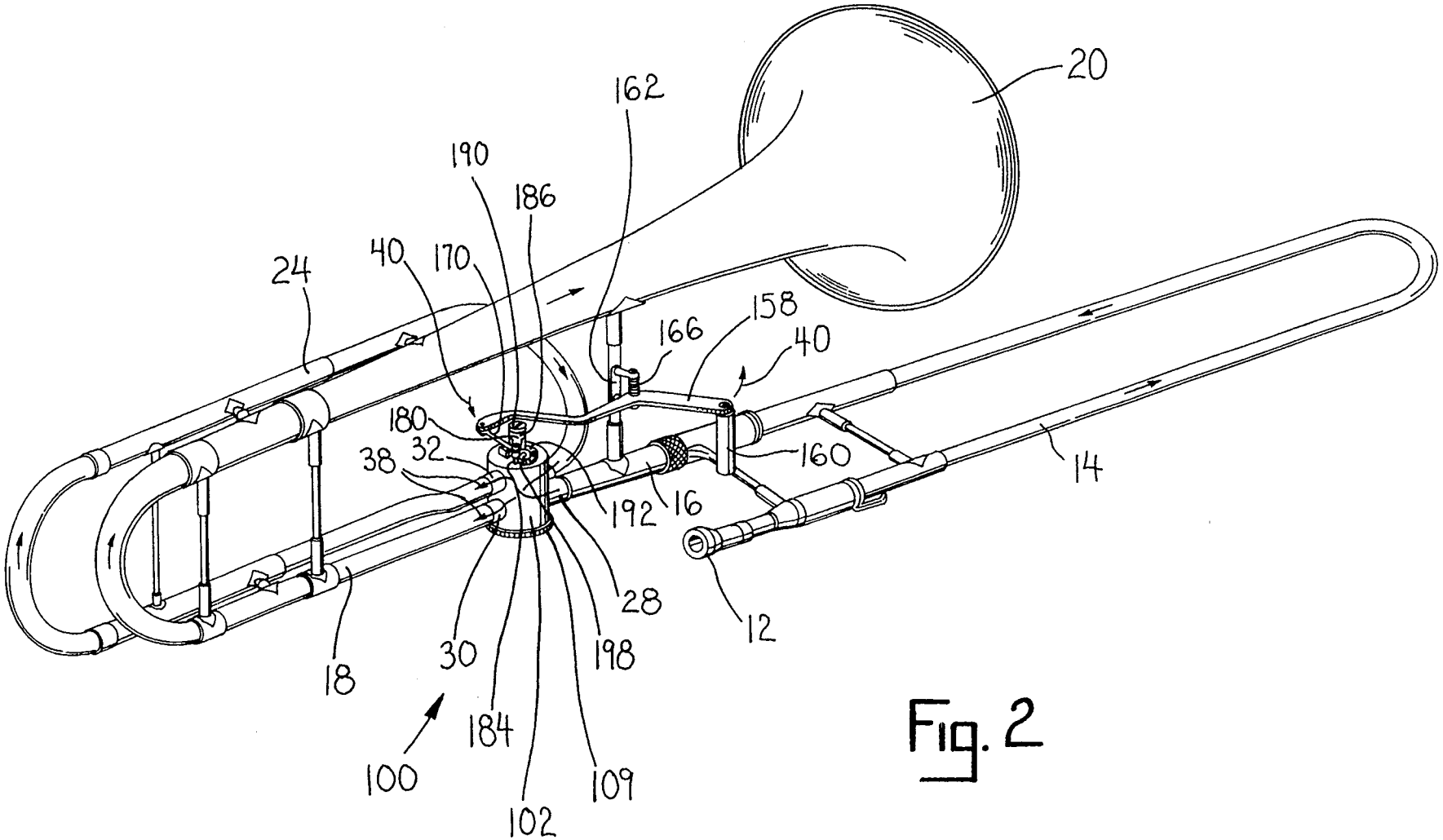
FIG. 2 is a perspective view of the trombone and the rotary air valve with the valve in a second position illustrating the air flow path through the slide loop.

Referring first to FIGS. 1 and 2, reference numeral 10 refers generally to a musical instrument which employs the valve 100 of this invention. Musical instrument 10 is shown as a common trombone for purposes of illustration, but valve 100 may be used in virtually any wind instrument which incorporates a secondary air passage.

Figure 4:
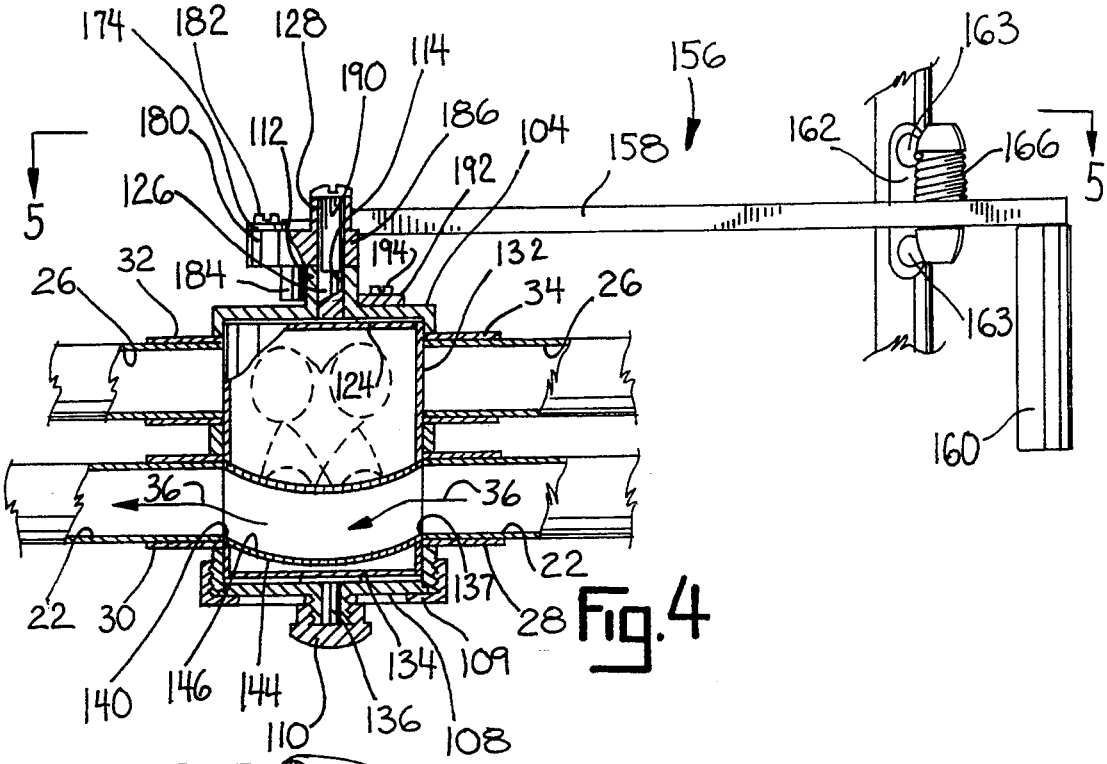
FIG. 4 is a fragmented sectional view of the valve in the straight through position.
Figure 5:
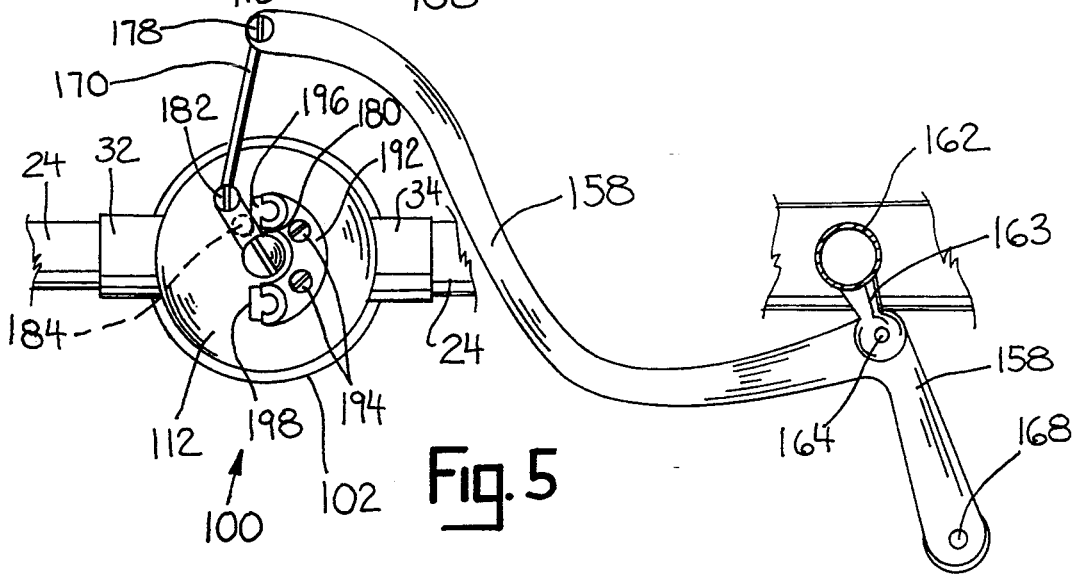
FIG. 5 is a fragmented plan view of the valve as seen from line 5 of FIG. 4.

Instrument 10 commonly includes a mouthpiece 12 a slide 14, main air conduit 16, lead pipe 18 and bell 20, all of which define a main passageway 22 (FIG. 4) through which air and sound travel to produce the musical tones characteristic of the instrument. Instrument 10 also includes slide loop 24 which defines secondary passageway 26 (FIG. 4). The basic component parts 12–26 of instrument 10 are conventional and further details will not be given here in the interests of clarity.

Figure 3:
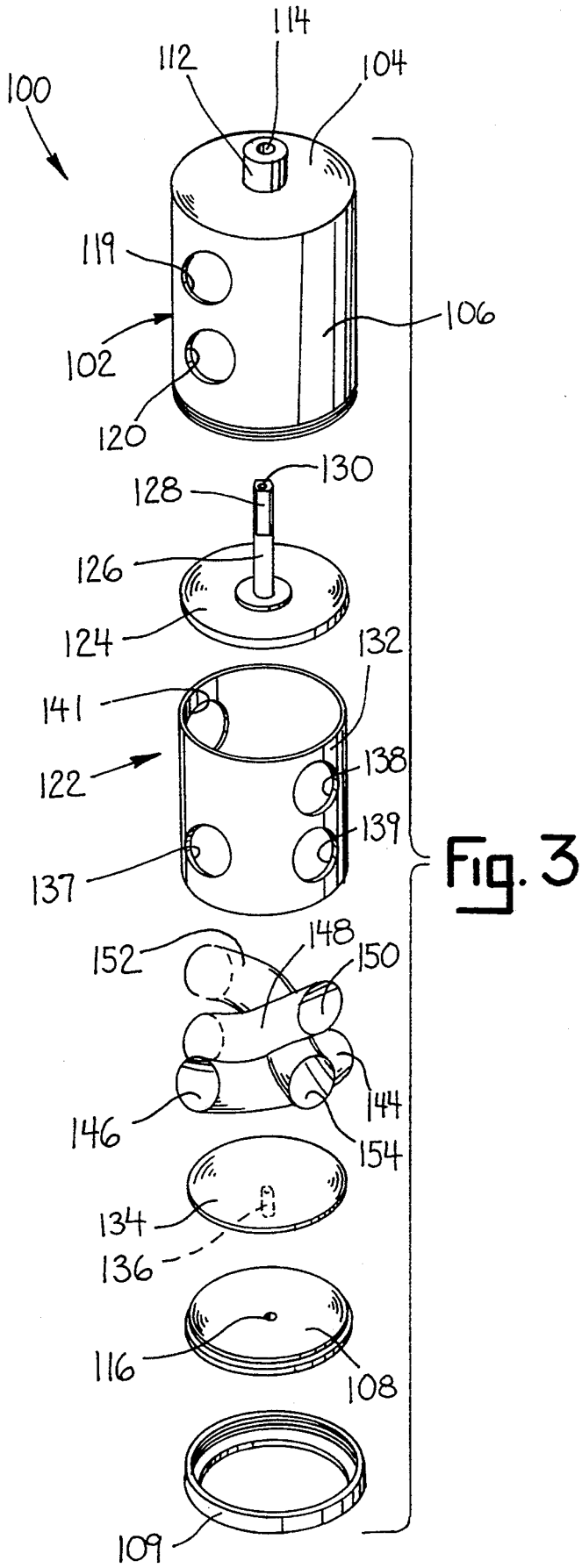
FIG. 3 is an exploded view of the valve and valve casings.

FIG. 3 illustrates the working components of valve 100 in perspective form. As shown, valve 100 includes an outer casing 102 which is generally cylindrical and includes top wall 104, a continuous side wall 106 and bottom wall 108 which is secured to side wall 106 as by a threaded ring 109 and threaded end cap 110. Top wall 104 includes an integral boss 112 which defines guide bore 114. Bottom wall 108 defines guide bore 116 as shown.

Casing side wall defines four apertures 117, 118, 119 and 120. Apertures 117, 118 are preferably axially aligned and are diametrically opposed to apertures 119, 120, respectively, which are also axially aligned with each other.

Rotor 122 is rotatably fitted in casing 102 and includes a top wall 124 which has a shaft 126 extending therefrom. Shaft 126 preferably includes a spline 128 and defines an upper threaded aperture 130. Rotor 122 also includes a side wall 132 and a bottom wall 134 which has a projecting pin 136.

Rotor side wall 132 defines six apertures 137, 138, 139, 140, 141 and 142. Apertures 137 and 140 are located near rotor bottom wall 134 and are diametrically opposed. A first conduit 144 extends diametrically across rotor side wall 132 and defines first passageway 146 which has its terminal ends aligned with apertures 137, 140 to provide for uninterrupted air flow through the first conduit from aperture 137 to aperture 140.

Apertures 138, 139 are positioned in an axially aligned relationship on rotor side wall 132 as shown, and are radially spaced from aperture 137. Apertures 141, 142 are also axially aligned and are diametrically opposed to apertures 138, 139 as shown. The preferred spacing between apertures 137 and 139, and apertures 140 and 142 is about 72°, but any acceptable spacing may be utilized.

Second conduit 148 extends across rotor side wall 132 and defines second passageway 150 which has its terminal ends aligned with apertures 138 and 142 to provide for uninterrupted air flow therebetween. A third conduit 152 extends across rotor side wall 132 and defines third passageway 154 which has its terminal ends aligned with apertures 139 and 141 to provide uninterrupted air flow therebetween.

Conduits 144 and 148 extend dramatically through rotor 122 with little or no radial deviation and only a slight axial curvature to minimize distortion of sound waves carried by the air traveling therethrough. Conduit 152 has a slight axial and radial curvature to afford its accommodation through rotor 122. These curvatures are also minimized to the greatest extent possible to minimize tonal distortion.

Rotor 122 is preferably a single piece unit when installed. Conduits 144, 148 and 152 are preferably connected to rotor side wall 132 as by welding or other conventional process. Rotor top wall 124 and bottom wall 134 are fixedly connected to side wall 132 by similar means.

Figure 6:
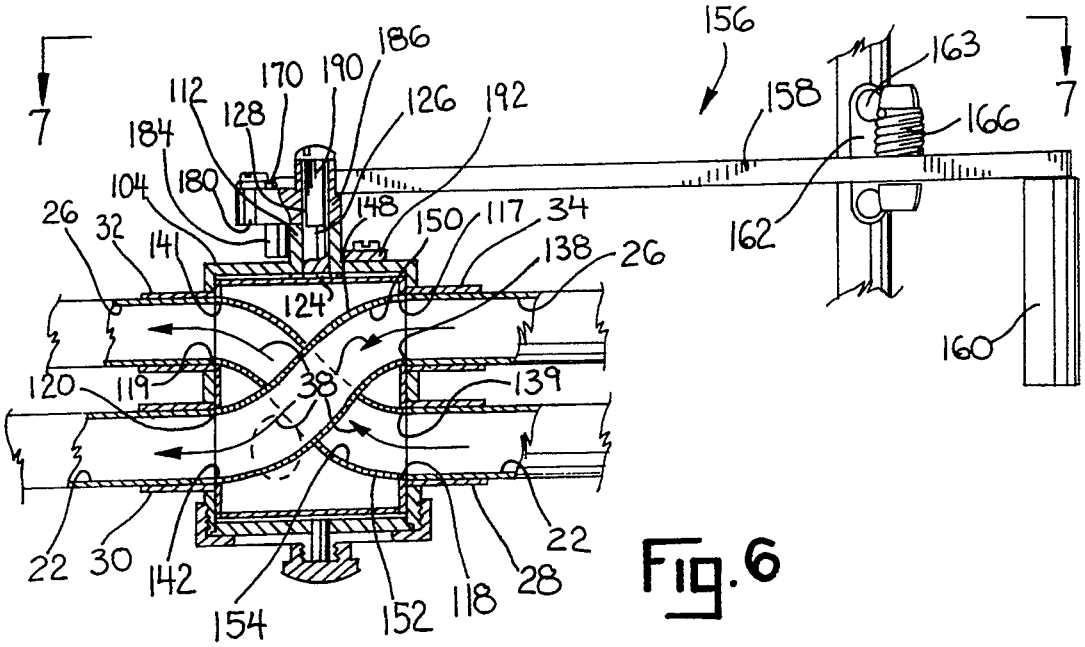
FIG. 6 is a fragmented sectional view of the valve in the slide loop diverted position.
Figure 7:
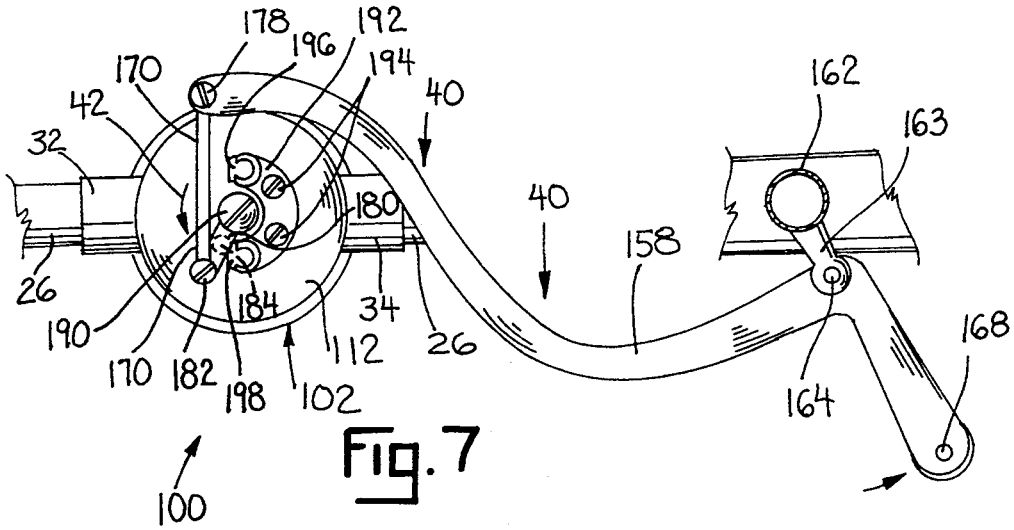
FIG. 7 is a fragmented plan view of the valve as seen from line 7 of FIG. 6.
Figure 9:
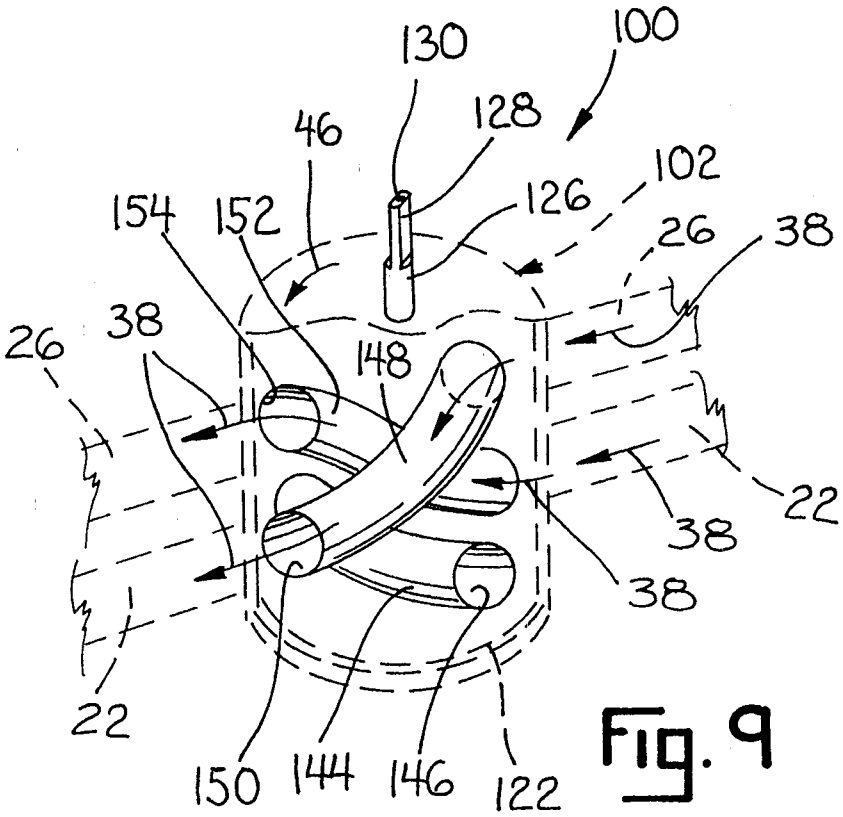
FIG. 9 is a fragmented perspective view of the valve air conduits in the slide loop diverted position.
Figure 8:
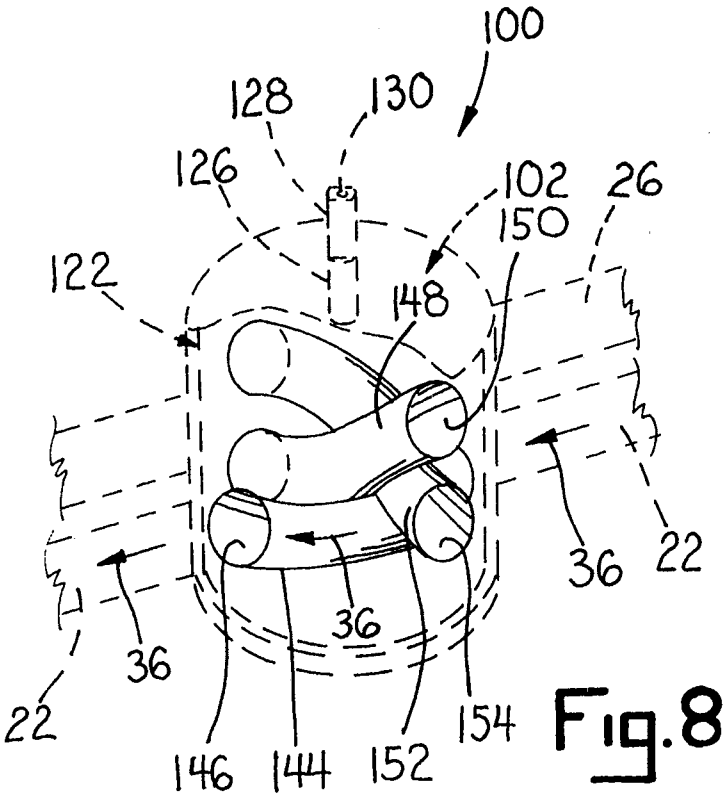
FIG. 8 is a fragmented perspective view of the valve air conduits in the straight through position.

FIGS. 4–7 illustrate the actuator means 156 which serves to rotate the rotor 122 between its first and second positions which will be described below. Actuator 156 includes a serpentine lever arm 158. U-bracket 162 is fixedly connected to instrument 10 as shown. U-bracket 162 includes threaded rod 164 (FIG. 10) which extends between the terminal ends of arms 163 and accommodates lever arm 158 through bore 159. Spring 166 circumscribes rod 164 as shown in FIGS. 4 and 6. Handle 160 is secured to a distal end of lever arm 158 as by threaded fastener 168.

Figure 10:
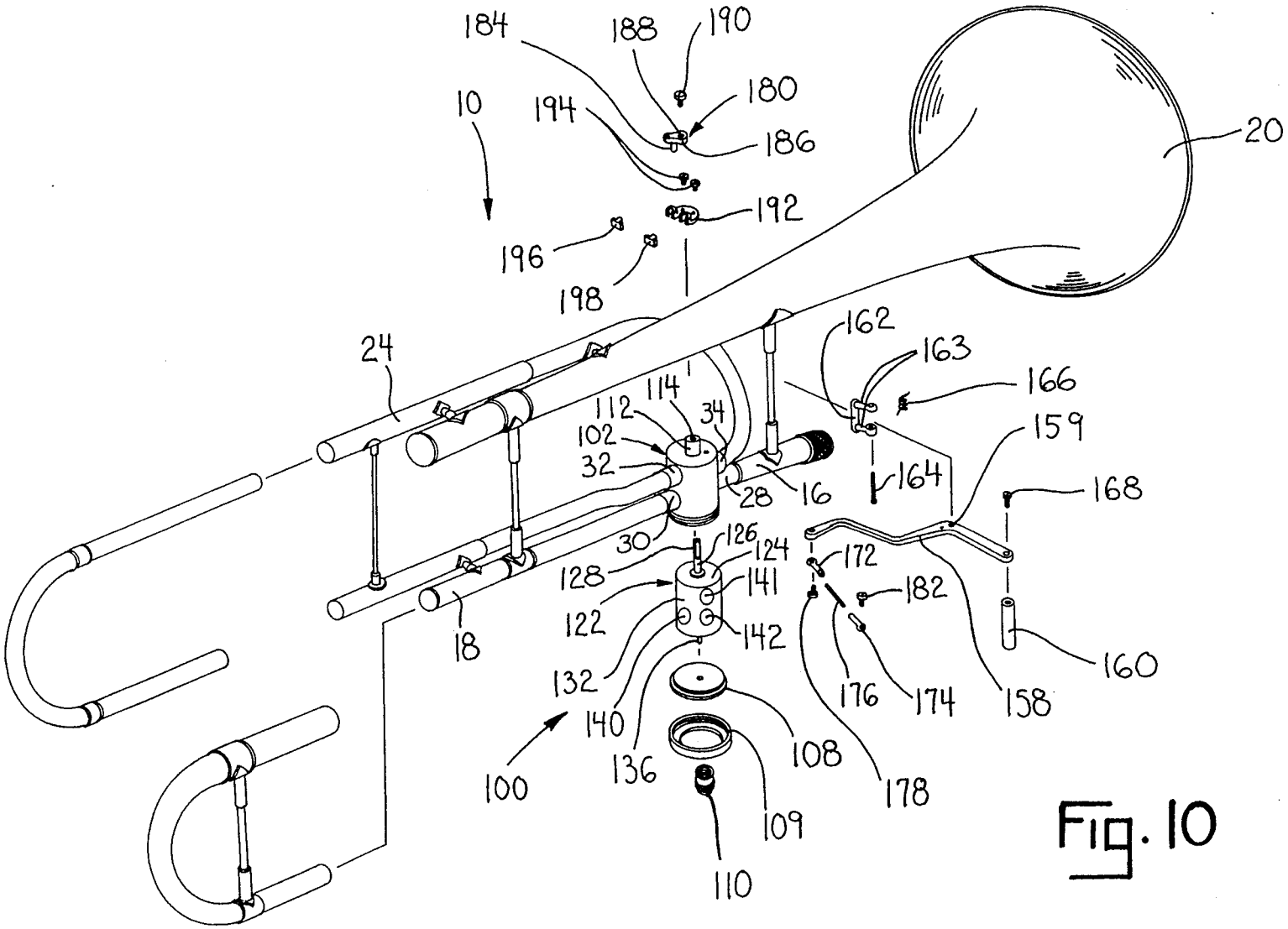
FIG. 10 is a partial exploded view of the trombone and the rotary air valve.

A first link 170 is connected to the proximal end of lever arm 158. First link 170 preferably includes I bolts 172, 174 connected by threaded fastener 176 as shown in FIG. 10. I bolt 172 is pivotally connected to lever arm 158 as by threaded fastener 178.

A second link 180 is pivotally connected to first link 170 as by threaded fastener 182. Second link 180 includes a lower projection 184 and a terminal ear 186. Bore 188 is defined through ear 186 and accommodates spline 128 of rotor shaft 126. Fastener 190 is threaded into shaft aperture 130 to fixedly secure the second link 180 to shaft 126.

Stop plate 192 is connected to rotor casing top wall 124 as by fasteners 194. Rubber or foam bumpers 196, 198 are connected to stop plate 192 as by conventional means such as adhesive.

Rotor casing 102 is positioned along the air flow passageways 22 and 26 of main conduit 16, lead pipe 18 and slide loop 24 as shown in FIGS. 4 and 6. Nipple 28 extends from rotor casing 102 and is aligned with casing aperture 118. Main conduit 16 is connected to nipple 28 as by welding or similar means. Nipple 30 extends from rotor casing 102 and is aligned with casing aperture 120. Lead pipe 18 is connected to nipple 30 as by welding to nipple 34.

Rotor 122 is rotatably positioned in casing 102 with its pin 136 located in casing bottom wall bore 116 and shaft 126 extending through guide bore 114 in boss 112. As shown, the air flow path in either the straight through fashion depicted by arrows 36 or the diverted slide loop fashion shown by arrows 38, is oriented generally perpendicular to the axis of rotation of rotor 122.

Rotor 122 is rotatable by manual shifting of lever arm 158 between a first or straight through air flow position, shown in FIGS. 1, 4, 5 and 8, and a second or diverted air flow position shown in FIGS. 2, 6, 7 and 9.

In the straight-through position, lever arm 158 has its handle 160 in its extreme position closest to valve 10. The extent of travel of lever arm 158 is limited by second link projection 184 contacting stop bumper 196. In this position, rotor first conduit 144 has its passageway 146, defined by apertures 137, 140, precisely aligned with casing apertures 118 and 120. Straight through air flow occurs in this position as depicted by arrows 36 with the air travelling through main air passageway 22, first passageway 146 and thence to the main air passageway and bell 20. In this straight through position of rotor 122, conduits 148 and 152 are radially removed from apertures 117–120.

Spring 166 presses against lever arm 158 to prevent slippage of the arm which could cause rotor 122 to wobble between the two positions. The pivotal connection of arm 158 to bracket 160 and links 170, 180 ensures that a minimum amount of push-pull force by the musician is necessary to quickly shift the rotor 122 between the two positions. This reduces transitional time and ensures a smooth even sound with little or no distortion, even when shifting rotor 122. The position of handle 160 is also conveniently accessible to the musician, who can normally perform the push-pull movement necessary without letting go of the instrument 10.

It is understood that this invention is not limited to the above description, but may be modified within the scope of the following claims.

What is claimed is:

1. A rotary valve for a musical wind instrument having a slide loop and a main air conduit terminating in a mouthpiece at one end thereof and an instrument bell at another end thereof, said valve comprising a casing having first apertures for accommodating said main air conduit, and second apertures for accommodating said slide loop, a rotor rotatably positioned in said casing, said rotor defining a first air passageway therethrough, a second air passageway therethrough, and a third air passageway therethrough, actuator means operatively coupled to said rotor for shifting said rotor between a first position with said first air passageway connecting said first apertures whereby air flows directly through said main air conduit, and a second position with said second air passageway connecting one of said first apertures with one of said second apertures to divert air flow into said slide loop and said third air passageway connecting another of said first apertures with another of said second apertures to divert air flow from said slide loop back into said main air conduit and thence to said instrument bell, said rotor being substantially cylindrical and defined by a continuous outer wall and upper and lower walls, first, second and third conduits in said rotor defining said first, second and third air passageways respectively, each said first, second and third conduits defined by a pair of first, second and third openings respectively in said rotor side wall, said first conduit positioned adjacent said rotor lower wall and its said first openings defining a first air inlet and a first air outlet, said second openings defining a second air inlet radially spaced from said first air inlet and a second air outlet axially and radially spaced from said first air outlet.

2. The rotary valve of claim 1 wherein said casing first apertures are axially aligned with each other and are diametrically opposed to one another, and said casing second apertures are axially aligned with each other and are diametrically opposed to one another.

3. The rotary valve of claim 1 wherein said third openings define a third air inlet and a third air outlet, said third air inlet radially and axially spaced from said first air inlet and axially aligned with said second air outlet, said third air outlet radially spaced from said first air outlet and axially aligned with said second air inlet.

4. The rotary valve of claim 1 wherein said rotor includes a shaft extending outwardly of said casing, said actuator means including a lever, linkage means connecting said lever to said rotor shaft, and means for shifting said lever between a retracted position with said rotor in said first position and an extended position with said rotor in said second position.

5. The rotary valve of claim 4 wherein said linkage means includes a first link pivotally connected to said lever and a second link pivotally connected to said first link at one end thereof means connecting said second link at an opposite end thereof to said rotor shaft.

6. The rotary valve of claim 4 and stop means connected to said casing for limiting travel of said lever between said extended position and said retracted position.

7. The rotary valve of claim 6 wherein said stop means includes a bracket connected to said casing, said second link including a depending projection contacting said bracket when said lever is in the extended and retracted positions.

8. The rotary valve of claim 5 wherein said first link includes a first eye bolt connected to said lever, and a second eye bolt connected to said second link, an adjustable threaded fastener connected between said first and second eye bolts.

9. A rotary valve for a musical wind instrument having a slide loop and a main air conduit terminating in a mouthpiece at one end thereof and an instrument bell at another end thereof, said valve comprising a casing having first apertures for accommodating said main air conduit, and second apertures for accommodating said slide loop, a rotor rotatably positioned in said casing, said rotor defining a first air passageway therethrough, a second air passageway therethrough, and a third air passageway therethrough, actuator means operatively coupled to said rotor for shifting said rotor between a first position with said first air passageway connecting said first apertures whereby air flows directly through said main air conduit, and a second position with said second air passageway connecting one of said first apertures with one of said second apertures to divert air flow into said slide loop and said third air passageway connecting another of said first apertures with another of said second apertures to divert air flow from said slide loop back into said main air conduit and thence to said instrument bell, said casing first apertures being axially aligned with each other and being diametrically opposed to one another, and said casing second apertures being axially aligned with each other and being diametrically opposed to one another, said axial alignment of said casing first apertures being parallel to said axial alignment of said second apertures.

10. The rotary valve of claim 9 wherein said rotor is cylindrical and defined by a continuous outer wall, said first, second and third air passages each intersecting said rotor outer wall.

* * * * *